US005312181A

United States Patent [19]

Hudnall

[11] Patent Number: 5,312,181

[45] Date of Patent: May 17, 1994

[54] ROTARY FILE AND STORAGE CABINET

[76] Inventor: Walter E. Hudnall, R.R. #2 Box 173, Nowata, Okla. 74048

[21] Appl. No.: 970,052

[22] Filed: Nov. 2, 1992

[51] Int. Cl.[5] ..... A47B 88/00

[52] U.S. Cl. ..... 312/249.2; 312/305

[58] Field of Search ..... 312/249.2, 249.3, 249.6, 312/305, 125, 286

[56] References Cited

U.S. PATENT DOCUMENTS

| | | | |
|---|---|---|---|
| 2,181,553 | 11/1939 | Hiller | 312/305 |
| 3,203,748 | 8/1965 | Toms | 312/305 X |
| 4,938,549 | 7/1990 | Potter | 312/249.2 X |

*Primary Examiner*—Timothy V. Eley
*Assistant Examiner*—Khan V. Nguyen
*Attorney, Agent, or Firm*—Francis X. LoJacono

[57] ABSTRACT

A rotary file cabinet defined by a base member on which is mounted two oppositely disposed side walls and two oppositely disposed access openings, wherein each access opening is defined by a pair of post members and a canopy mounted to the post members, wherein a rotor file assembly is rotatably mounted on a vertical rotor support member defined by a fixed central axis positioned between the canopy and the base member of the cabinet housing, and wherein the rotor file assembly is formed having a coaxial support housing, a support frame mounted to the coaxial support housing, and a pair of oppositely disposed closure doors mounted to the support frame, defining a pair of storage bay sections disposed therebetween so as to provide access through the access openings of the cabinet housing when the file frame assembly is rotated from a closed position to an open position.

26 Claims, 10 Drawing Sheets

12
10c
30
12
10b
30
12
10a
30
40
20
26
14
152
19
28
152
26
13
13
152
14
29b
29a
26
14
28

10
45
30
45
38
22
27
12
96
17
14
16
17
20
4
17
40
27
42
40
17
21
4
130
22
42
21

10
128
92
94
128
30
116
118
129
110
116
117
114
116
118
110
116
117
114
116
118
110
116
118
100
102
120
126
123
125
124
125
120
27
124
106
106
108
108
126
112
112
27
126
125
34
125
111
28
108
28
106
96
98
112
114
116
118
114
112
116
118
110
110
116
116
117
137
116
118
136
110
136
118
130
10
144
132
35
146
150
166
160
138
142
114
32
70

ROTARY FILE AND STORAGE CABINET

BACKGROUND OF THE INVENTION

1. Field of the Invention

The present invention relates generally to a rotary file cabinet, and more particularly to a rotary file and/or storage cabinet having a rotor file assembly that includes a rotatable support apparatus that is readily rotatable about a vertical axis which provides a well balanced configuration so as to carry various shelf structures or other related storage structures in two oppositely positioned storage bay sections during the rotation of the rotor file assembly from one position to another.

2. Description of the Prior Art

As is well known in the art, various problems and difficulties are encountered in providing suitable means for operating and supporting various rotatable file structures that are employed in rotary file cabinets.

Many types of rotary file cabinets have been tried, suggested and several are in use at this time. However, these known rotary file cabinets have various limitations that restrict their use and are unsuitable for extended use due to the inadequate designs of their respective rotary support systems or assemblies. Such known systems are commonly employed as a means of supporting and rotating a particular file support structure. Many rotatable support systems are not adequately designed to carry the heavy loads that are supported within their structures, and this is particularly true when a load is unequally distributed on the shelves within the file bays of the cabinet. Moreover, many of the known commercial rotary file cabinets are complicated, not only in their construction but also in their operation, and thus are often expensive to maintain. As examples of some of the known rotary file cabinets one may refer to any of the following United States Patents.

There is disclosed in U.S. Pat. No. 3,868,157 to Gerard A. Robinson a rotary file cabinet which comprises a cabinet having a top cover and a base member which itself forms part of a rotatable bearing unit. The particular arrangement of the rotatable bearing unit is often referred to as a lazy-susan and includes an upper bearing plate and a lower bearing plate which is part of the top wall of the base member. Both bearing plates are formed having matching circular ring-shaped depressions which together define a ball race for balls as is well known in the art for this type of bearing structure. Thus, the Robinson's bearing device is the principle supporting means for the rotatable shelf structure as the bearing device is interposed between the base member and the rotary shelf structure which is completely supported by the bearing device. The rotatable shelf structure is held in a vertical alignment by a trunion member defined by an axle pin mounted in the upper cover which is received in an aligned small bushing and a pivot bolt that is centrally mounted in the bottom of the rotatable shelf structure and affixed to the base member.

Other types of rotary file cabinets having similar flat rotary support bearing units are also disclosed in U.S. Pat. No. 4,229,060, U.S. Pat. No. 4,239,311, U.S. Pat. No. 4,258,966 and U.S. Pat. 4,300,809 to Sherwood S. Brownlee, and in U.S. Pat. No. 4,241,964 and U.S. Pat. No. 4,258,966 to Frederick H. Grubb, Jr.

In U.S. Pat. No. 4,928,549 to Frank Potter, there is disclosed a cabinet having a rotary file unit supported by an inner post having an outer hexagon rotatable post on which are mounted a plurality of radial shelves.

SUMMARY OF THE INVENTION

The present invention defines a rotary file cabinet which is adapted to be used as either a single file cabinet or as a group of interconnected side-by-side units arranged in multiples so as to provide a high-volume, high-activity, double-bay file and/or storage system that provides access from either side of each cabinet. Each unit comprises a cabinet housing having a rotor assembly which is rotatably supported on a coaxial support unit which comprises a fixed vertical shaft and a rotatable coaxial housing assembly. The coaxial housing assembly is rotatably supported by a single thrust bearing mounted at the upper end of the fixed shaft, and is adapted to carry heavy loads along with at least two spaced-apart pilot bearing sleeve members which are positioned between the fixed shaft and a coaxial housing so as to rotatably support the coaxial housing in such a manner as to prevent excessive wear on the housing and the thrust bearing that might be caused by the unbalanced load of the various stored or filed material. Thus, this unique bearing system prevents excessive wear, particularly when the rotor assembly is unevenly weighted by stored or filed material as mentioned.

A file support frame structure is arranged to include oppositely disposed front and rear closing panels or doors and a pair of oppositely arranged shelf support fixtures that define back-to-back shelving bays which are adapted to receive various shelf structures or any other suitable platform or storage devices that might be required for the filing and storing of specific files or articles. Positioned above the support base and attached to the bottom of the frame structure is a rotor positioning disk or plate which is provided with at least four detents or recesses formed in the peripheral edge of the disk in which a spring-loaded latching roller is removably received so as to engage the recesses as the file structure is rotated in ninety degree increments. The cabinet is preferably rectilinear, whereby two open sides are provided to allow access to the files from either side of the cabinet as may be required.

Thus, an important object of the present invention is to provide a file cabinet that includes a rotor assembly that defines a rotatable file support assembly that includes a vertically mounted support shaft fixedly mounted between the canopy top and a secured support base, whereby the strength and integrity of the vertical shaft is aided by its direct connection with the cabinet frame structure. A coaxial tubular housing is rotatably supported on the fixed shaft by a simple but effective bearing system that overcomes the problems found in the prior art which generally employs a lazy-susan type bearing fixture located at the bottom of the cabinet on which is supported a rotatable shelving structure. The coaxial tubular housing is defined by a pair of elongated housing sections that are secured together along a pair of vertical flange members to which a shelf-supporting frame structure is mounted.

Another object of the invention is to provide a simple but easy self-operating positioning device, whereby the two front door panels of the rotor assembly can be readily rotated in 90 degree increments from a closed position to an open position, thereby exposing the two oppositely disposed file sections that provide access to the stored files therein.

Still another object of the invention is to provide a rotary file cabinet wherein the rotor support assembly is so arranged as to be supported by a bearing means that will overcome an unbalanced load which is inherent in most known rotary file systems.

A further object of the present invention is to provide a rotor support assembly that uses a single-thrust bearing mounted at the top of a fixed vertical shaft on which is supported the rotatable shelf assembly. A pair of pilot bearings are interposed between the fixed shaft and the coaxial rotatable tubular housing and are located adjacent the top and bottom of the housing. This novel rotor support assembly prevents the occurrence of an unbalanced condition which is commonly caused by side-loading.

A further object of the invention is to provide a rotor support assembly that includes a fixed positioning pin which extends into a location bracket fixedly attached to the canopy top, whereby the rotor assembly is held in a central, vertical position relative to the four post of the cabinet and the canopy top assembly. The base member of the cabinet is provided with a keeper-bolt arrangement which prevents the rotor assembly from lifting the positioning disk out of engagement with the spring-loaded roller.

Still a further object of the invention is to provide a rotary file cabinet that has a very simple file frame structure that is easily assembled and rigidly secured so as to support substantial file loads.

It is a further object of the present invention to provide a rotary file cabinet of this character that is relatively inexpensive to manufacture, and is simple yet rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts, in which.

DESCRIPTION OF THE PREFERRED EMBODIMENT

Figure 1A:
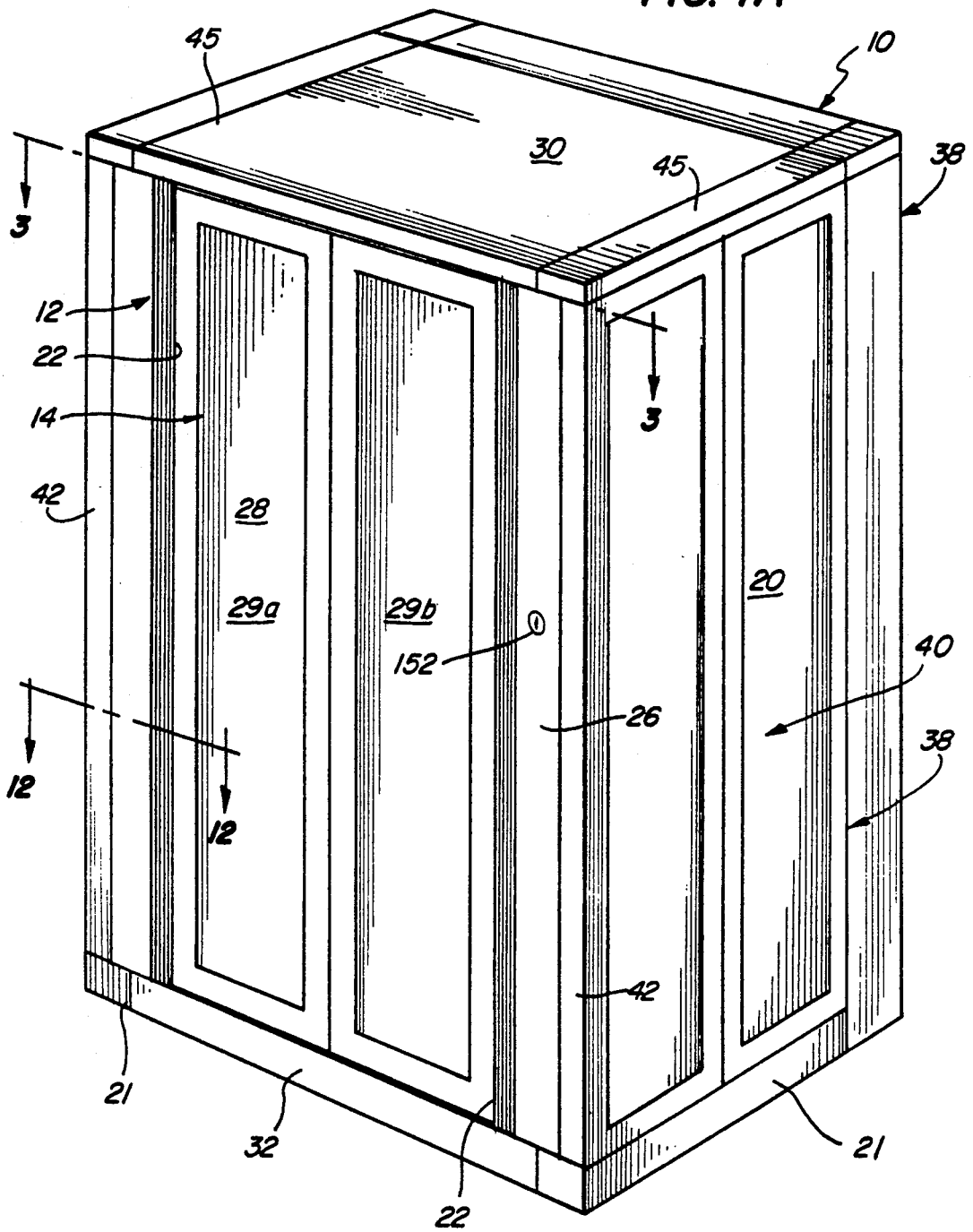
FIG. 1A is a perspective view of the present invention showing a single file cabinet with an internal rotor assembly positioned in a closed mode.

Referring more particularly to FIG. 1A, there is shown a rotary file and/or storage cabinet of the present invention which is generally indicated at 10 and is illustrated in this view as a single unit comprising a cabinet housing 12 having a generally rectangular or square cross-sectional configuration. The cabinet housing is defined by four rectilinear sides in which is mounted a rotor file assembly, designated at 14. As seen in FIG. 1A, the rotor file assembly 14 is shown positioned in a closed mode while in FIG. 2 the rotor file assembly is shown in an open position, wherein the rotor file assembly has been rotated 90 degrees to expose one of the two oppositely positioned double-bay file or storage sections which are more clearly illustrated in FIG. 3, and generally designated at 16 and 18. It should be noted that typical flat shelves 17 are shown mounted therein.

Figure 1B:
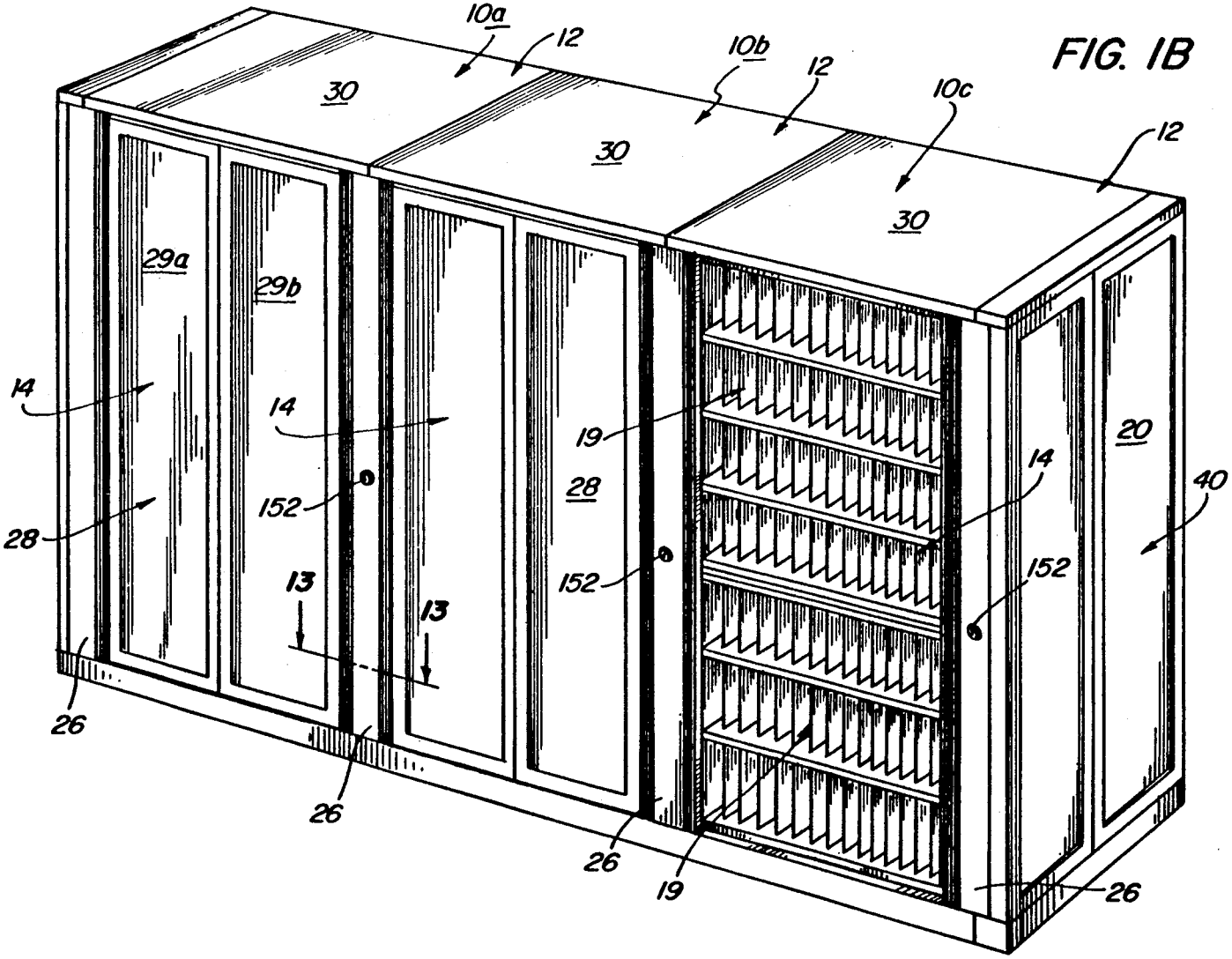
FIG. 1B is a perspective view of the present invention showing a multiplicity of file cabinets interconnected to define a group of file cabinets.

In FIG. 1B there is shown a second embodiment of the present invention, wherein a multiplicity of cabinet units 10*a*, 10*b* and 10*c* are arranged in an contiguous interconnected manner, and wherein each cabinet unit includes an independent rotor file assembly 14 and is shown having another form of shelving, generally indicated at 19. The specific structural arrangement thereof will hereinafter be described in more detail. Thus, for the purpose of simplicity the single cabinet unit 10 will first be described in detail since each of the connected cabinet units is provided with an identical rotor file assembly.

Figure 2:
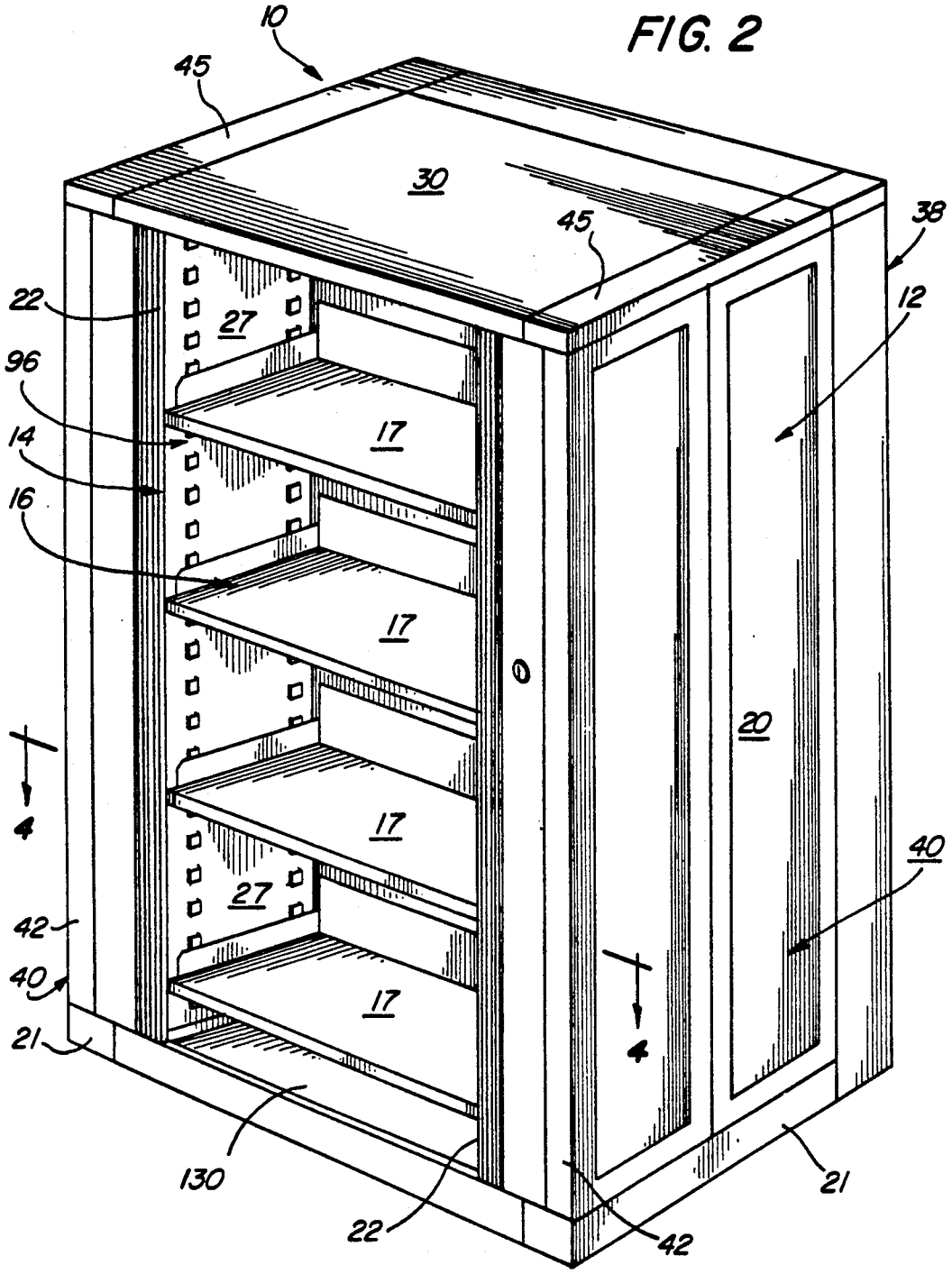
FIG. 2 is a perspective view of the file cabinet similar to that shown in FIG. 1A but in an open mode and illustrating the internally mounted rotor assembly being positioned so as to expose one of the shelving bays.
Figure 3:
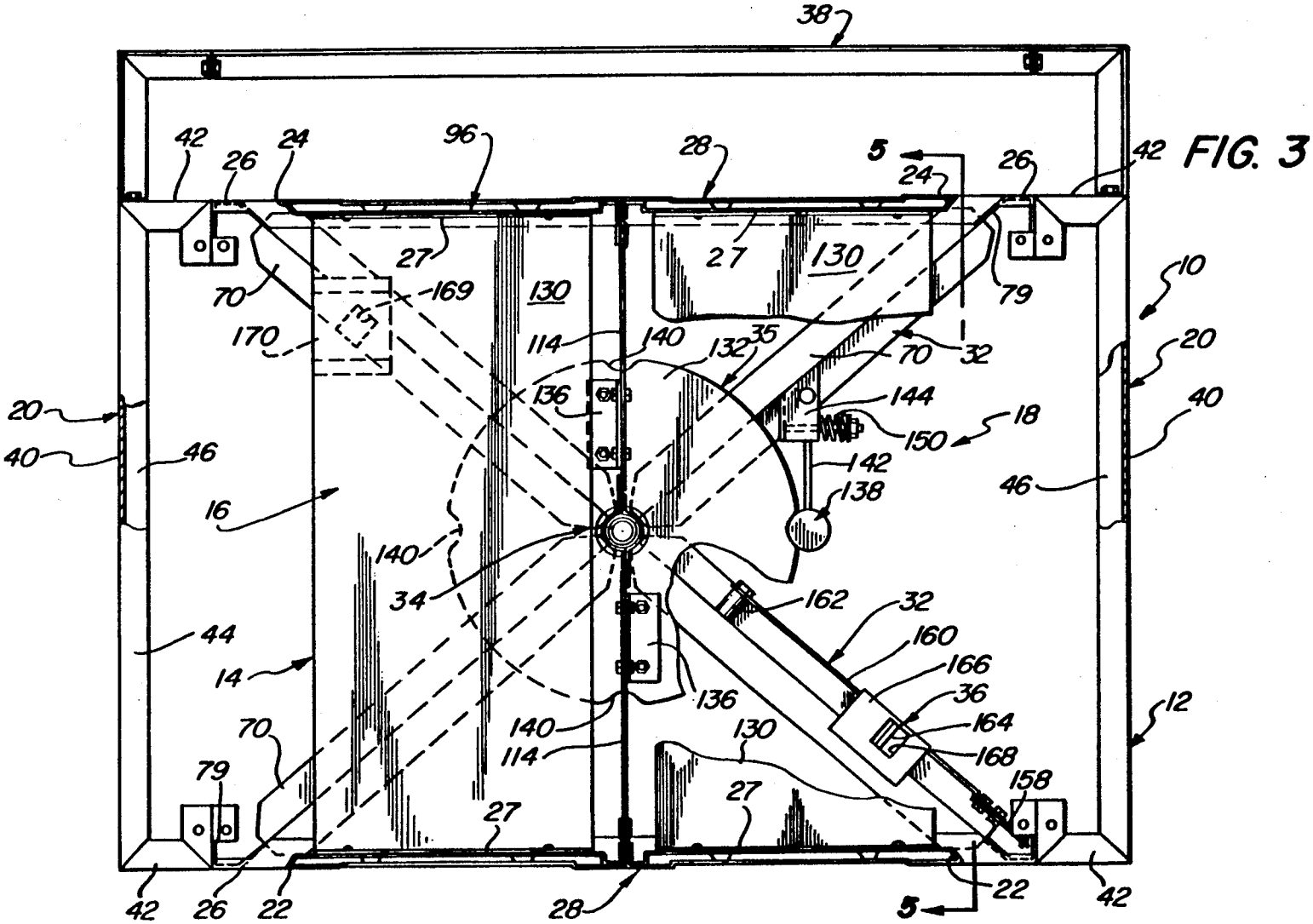
FIG. 3 is an enlarged top view taken substantially along line 3—3 of FIG. 1A illustrating the cabinet with the canopies removed, showing the rotor assembly in the closed position, wherein the double-bay file and/or storage compartments are in a closed position, one of the bottom closure covers being broken away to expose the rotor-positioning apparatus at the base thereof.

Accordingly, in FIGS. 1A, 2, 3, and 4 housing 12 comprises side closure walls 20 and two oppositely disposed access openings 22 and 20 which are each defined by a pair of post assemblies 26 that are arranged to allow closure doors 28 of rotor file assembly 14 to be rotated to a closed positioned, as illustrated in FIGS. 1A and 3. The details of post assemblies 26 are better seen in FIGS. 12 and 13 and are hereinafter described in detail. The top of the cabinet housing 12 is closed off by means of a cover or canopy 30, and the bottom of housing 12 is supported and attached to a base member 32 on which is centrally mounted a rotary support means, generally designated at 34, a rotor positioning means 35 and a locking means being indicated at 36 in FIGS. 3, 4, 5 and 6.

Figure 4:
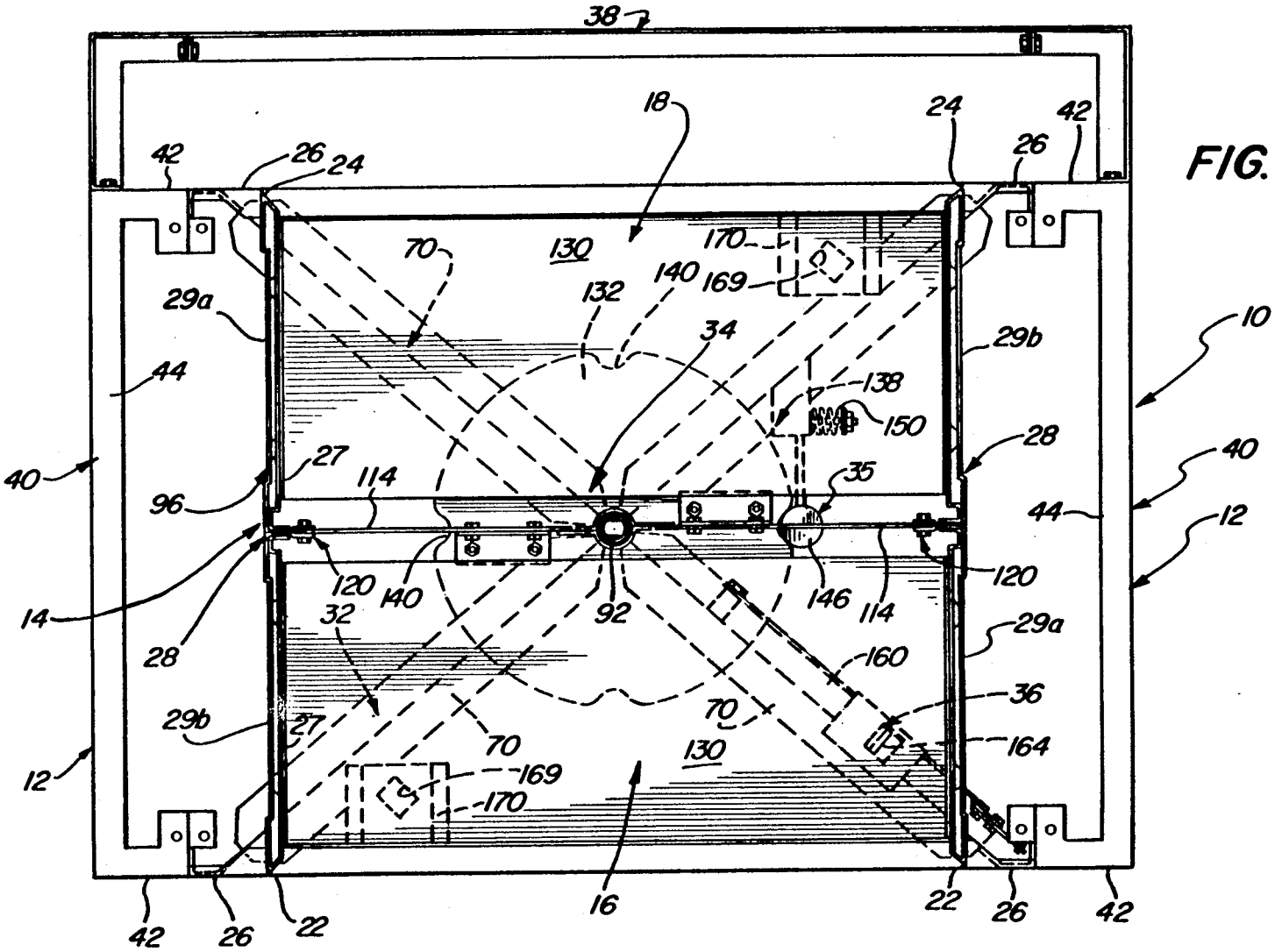
FIG. 4 is an enlarged top view substantially similar to that which is shown in FIG. 3 but showing the rotor assembly rotated ninety degrees to define an open position.

Also seen in FIGS. 3 and 4 is a removable rear cover wall section, indicated at 38. This rear cover wall section is to be used when the cabinet or cabinets are positioned along a wall of a room or when access is to be provided to only one of the two access openings 22 and 24. The rear cover wall section is removed when both access openings are to be used, as is illustrated in FIG. 1B. It should be also mentioned at this time that one or both of the end walls 20 are removed when a multiplicity of file cabinet are interconnected, as illustrated in FIG. 1B. The arrangement of the contiguously positioned file cabinets in FIG. 1B is shown having rear wall sections 38 removed from the cabinet housing 12, so that complete access to both oppositely disposed access openings 22 and 24 is provided as mentioned above, and can thus be employed as a room divider if desired.

Figure 12:
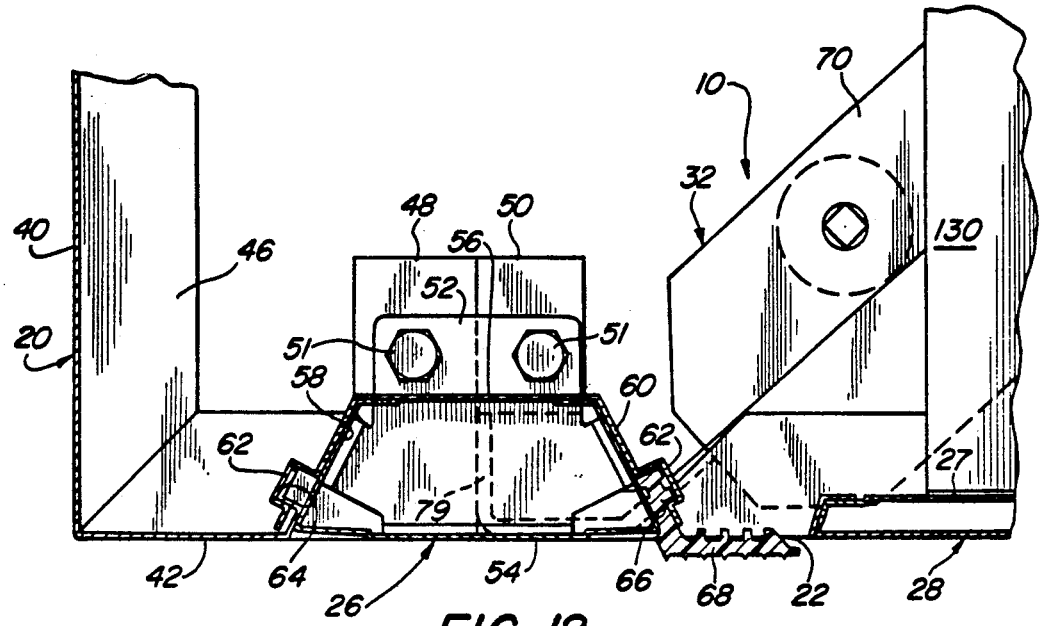
FIG. 12 is an enlarged cross-sectional view taken substantially along line 12—12 of FIG. 1A.
Figure 13:
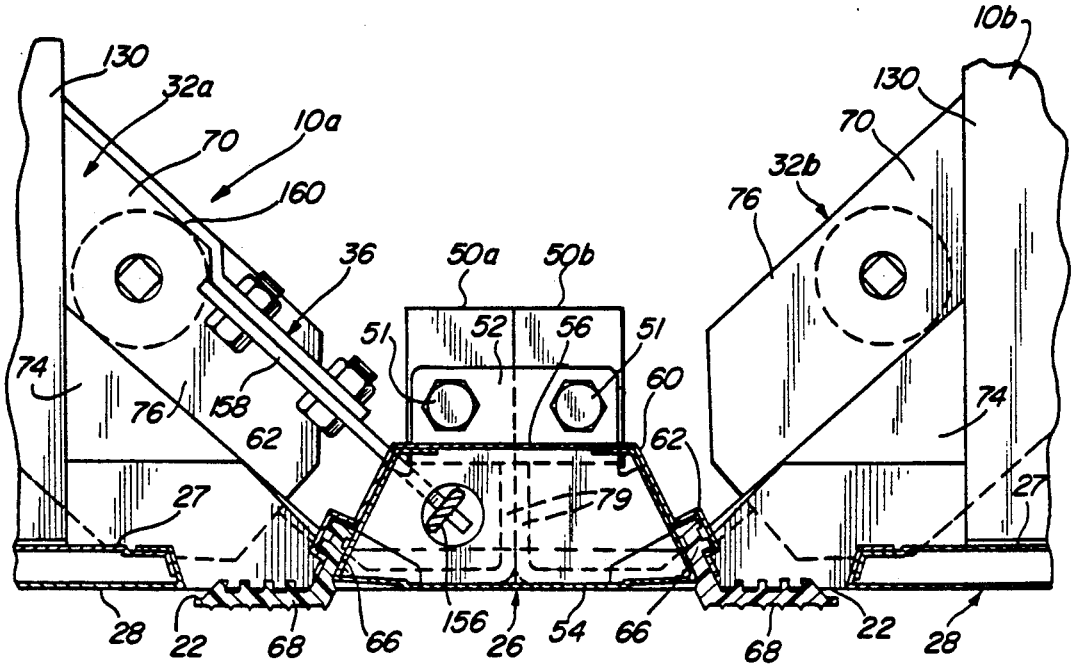
FIG. 13 is an enlarged cross-sectional view taken substantially along line 13—13 of FIG. 1B.
Figure 14:
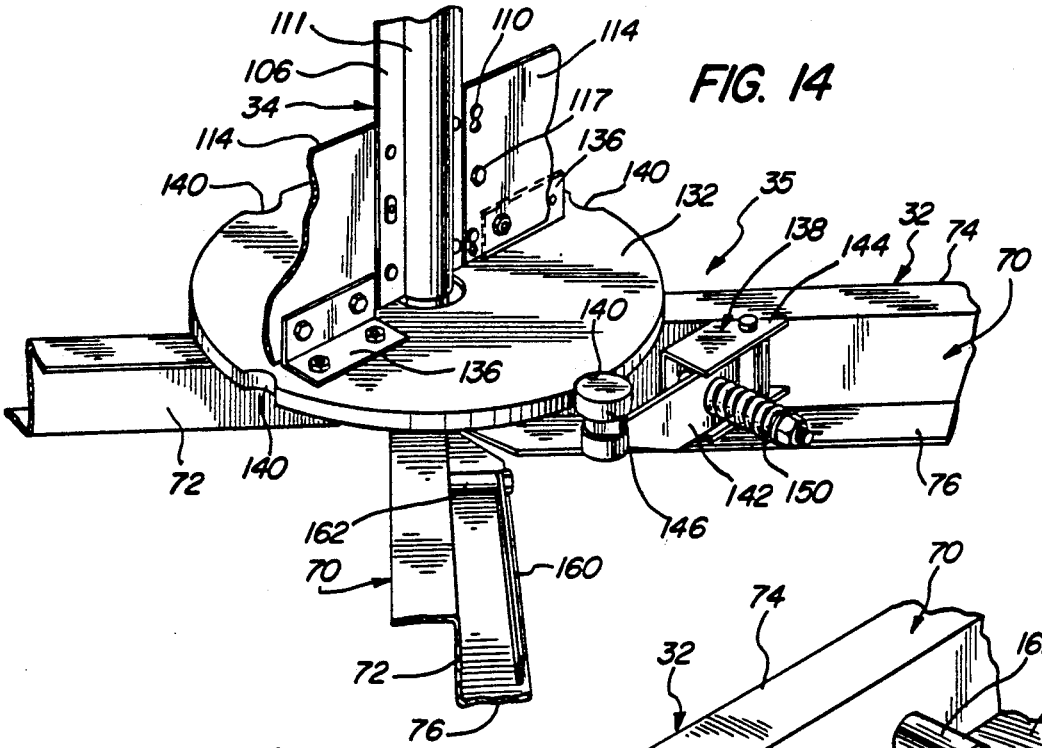
FIG. 14 is a perspective view of the rotor-positioning apparatus.

In FIGS. 1A and 2 each end wall 20 is shown being supported by and mounted on a bottom skirt member 21. End wall 20 is formed having an enlarged end panel, generally indicated at 40, with inwardly bent side members 42 which are arranged to abut and interconnect with respective box-post members 26, as can be seen in FIG. 12. Both the upper and lower edge of end panels 40 include inwardly bent flange members 44 and 46, respectively. The upper flange member 44 is adapted to receive a narrow cover member 45, with canopy cover 30 being interposed between the end cover members 45, as seen in FIGS. 1A and 2. The terminating ends 48 of bottom flange member 46 project inwardly (See FIG. 12) and are adapted to be secured to a respective corresponding extended flange member 50 formed on base member 32. The bottom of post member 26 is provided with an attaching bracket 52 which is secured to the abutting flange members 48 and 50 by a suitable means which is herein shown as bolts 51. Each vertical post member 26 is formed as an elongated tubular box member having front and rear walls 54 and 56 and angularly displaced side walls 58 and 60, respectively. Side walls 58 and 60 are provided with a longitudinal securing means comprises of mounting clips 62 which are adapted to correspondingly receive and lock into place with either the longitudinal keeper edge 64 of the side panel 42 of end wall 20 or the keeper edge 66 of a vinyl molded strip 68. It should be noted that molded strips 68 together with post members 26 define access openings 22. The mounting of box post 26 between end wall 20 and flexible strip 68 is better shown in FIG. 12. However, in the sectional view of FIG. 13, which is taken from FIG. 1B, box post 26 is shown mounted so as to straddle the adjacent parts of each base member, whereby the post is interconnected between juxtaposed cabinet units 10*a* and 10*b*, wherein a strip 68 is secured in each oppositely positioned mounting clips 62. Each of the box posts 26 is similarly mounted at its upper end.

Not only does the base member 32 provide a means to support the walls of the cabinets, but it also provides the support base for rotor file assembly 14 which is centrally mounted thereon, whereby the rotor file assembly can be rotated 360 degrees in either a clockwise or counter-clockwise direction as may be required when opening the back-to-back, double-bay file sections 16 and 18. Base member 32 comprises four support beams or leg members 70, each being preferably formed having a substantially Z-shaped, cross-sectional configuration defined by a vertical wall member 72, an upper outwardly extended flange member 74, and a lower flange member 76 that extends in an outwardly direction opposite that of flange 74. Support beams or legs 70 are fixedly secured to a central sleeve 78 by a suitable means such as welding or the like. The beams are mounted to sleeve 78 so as to form a substantially cross-like configuration with each beam extending outwardly lengthwise towards each respective corner of the file cabinet. Accordingly, the elements such as end walls 20, canopies 30 and box posts 26 of the cabinet structure are all secured together, thereby providing a very rigid lightweight cabinet that prevents twisting of the cabinet structure. This twisting is referred to as torque-loading and has been a long standing problem in known rotary file and storage cabinets.

Figure 6:
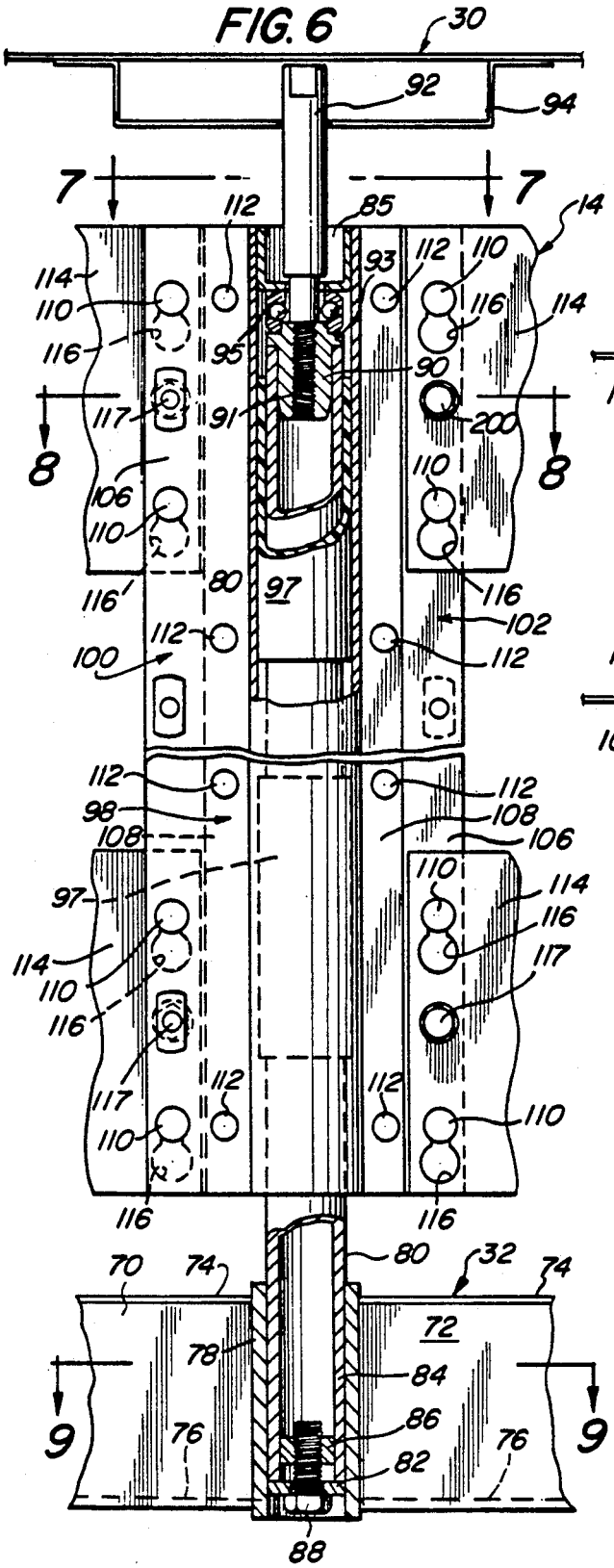
FIG. 6 is an enlarged vertical plan view of the rotatable coaxial support assembly taken in the direction of line 6—6 in FIG. 4 with the upper and lower portions thereof being broken away to show the mounting arrangement of the centrally positioned fixed shaft and the rotatable coaxial housing assembly, both of which are mounted between the top canopy and the base member of the cabinet.

Rotor assembly 14 is rotatably supported on base member 32 but does not rotate in the leg structure of the base member. This is due to the novel centrally mounted rotary support means 34, as seen in FIG. 6, which comprises an axis assembly defined by a fixed central hollow pole 80 that is secured in sleeve 78 by means of a hold-down plug 82 fixed adjacent the bottom of sleeve 78 on which the lower end 84 of pole 80 rests. Fixedly mounted inside of lower end 84 is a threaded plug 86 which is adapted to receive bolt 88 that is mounted through hole 89 formed in hold-down plug 82. The upper end of hollow pole 80 is provided with a bearing mount 90 which is formed having an annular bearing support flange 93 and a threaded bore 91 in which is received a non-rotatable positioning pin 92 which extends upwardly through a cap 85 and into a retainer housing 94 that is mounted to the underside of canopy 30. Thus, central pole 80 is vertically fixed between retainer housing 94 and base 32. A thrust bearing 95 is mounted on the bearing support flange 93 of bearing mount 90, whereby a file frame assembly, designated generally at 96, is rotatably supported thereon and is adapted to receive and support various file supporting shelves as well as slidable drawers or suitable like devices for holding articles for storage and simple retrieval. Included as part of file frame assembly 96 is a coaxial support housing 98 which is rotatably mounted coaxially over fixed pole 80 and is basically supported by means of cap 85 on a single thrust bearing 95. As an example, an E-2 series bearing manufactured by Aetna Bearing Company is very suitable for this purpose. This bearing provides a thrust-load capacity of 4400 pounds, whereas the maximum loading on the file frame assembly will reach only 2000 pounds.

Figure 7:
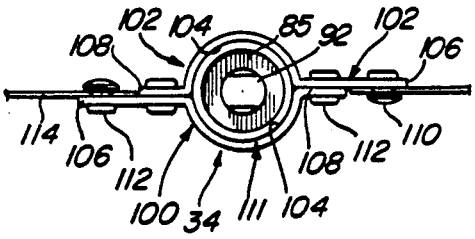
FIG. 7 is a top plan view of the coaxial support assembly taken substantially along line 7—7 of FIG. 6 thereof.
Figure 8:
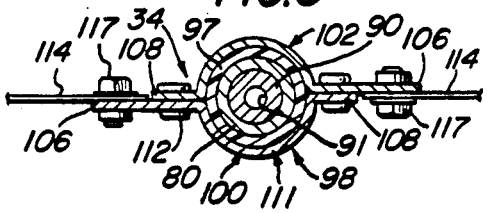
FIG. 8 is a cross-sectional view taken substantially along line 8—8 of FIG. 6 thereof.
Figure 9:
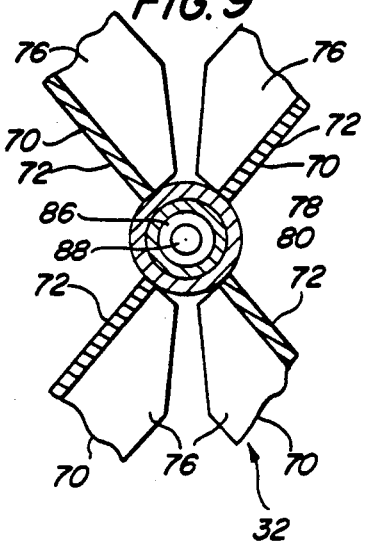
FIG. 9 is a cross-sectional view taken substantially along line 9—9 of FIG. 6 thereof.

To further provide a stabilizing support and vertical alignment means for file frame assembly 96, there is included a plurality of pilot sleeve bearings 97, as indicated in FIGS. 6 and 8. These pilot sleeve bearings are mounted over a fixed pole 80 so as to be interposed between the pole and a coaxial support housing 98 by which is provided a means to prevent any side overloading. Coaxial support housing 98 comprises a pair of housing sections 100 and 102, wherein each housing section is formed having an elongated body provided with a semicircular longitudinal groove 104 and a pair of oppositely disposed flange members 106 and 108. Flange 106 is formed with a substantially larger width than flange 108, and flange member 106 includes attaching means defined by at least four pairs of flat-head mounting pins 110. The first two pairs of mounting pins are located at the upper end of flange member 106 and along the adjacent outer edge thereof, while the second two pairs of mounting pins 110 are located at the lower end of flange 106 in alignment with the upper positioned pins 110. Housing sections 100 and 102 are secured together so as to match grooves 104 with each other to define a coaxial tubular housing 111 so as to receive pole 80. The oppositely positioned housing sections 100 and 102 are fixedly attached to each other by suitable means such as rivets 112 that are mounted through the narrow flange members 108 and the corresponding inner portion of the larger flange member 106, as illustrated in FIGS. 6, 7 and 8.

Figure 11:
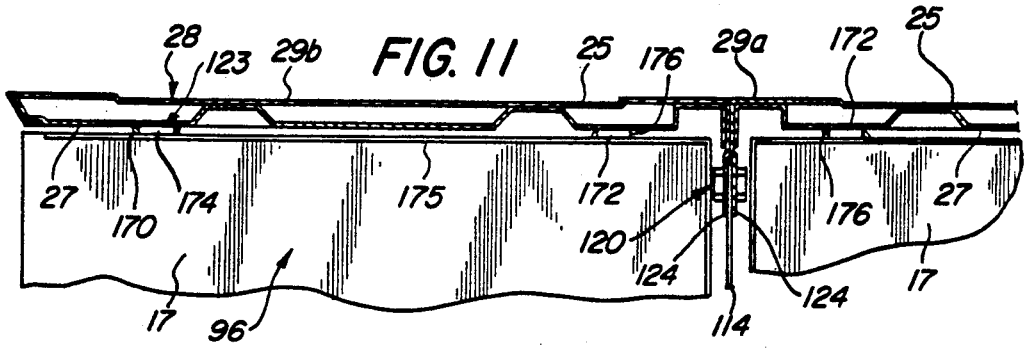
FIG. 11 is a cross-sectional view taken substantially along line 11—11 of FIG. 10.
Figure 10:
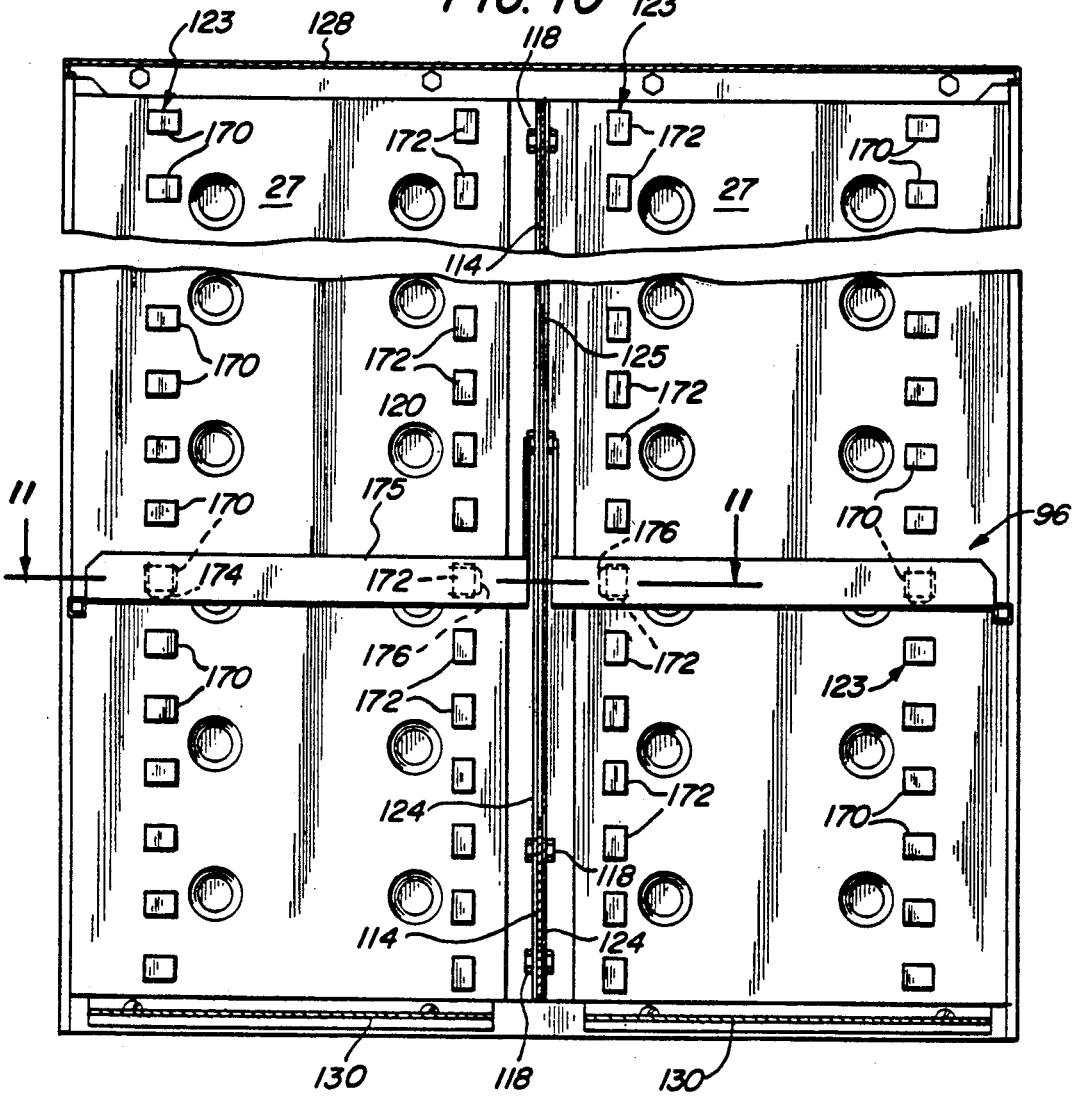
FIG. 10 is a cross-sectional view taken substantially along line 10—10 of FIG. 5, showing the shelf-mounting arrangement formed as part of the inner wall of the closure panels.

The file frame assembly 96 further includes a plurality of cross-tie plates, which are herein shown as four cross-tie plates, designated at 114. Two cross-tie plates are mounted to the respective two upper pairs of flat-head mounting pins 110, and the second two cross-tie plates are mounted to the two lower pairs of flat-head pins 110 by means of corresponding key holes 116 disposed therein so as to extend outwardly from the opposite sides of the coaxial support housing 98. (See both FIGS. 5 and 6.) The mounting arrangement between the cross-tie plates 114 and the housing section members provides for a faster and easier method of assembling each cabinet as a single unit or as an interconnected group of units. This arrangement is particularly suitable when the cabinet or cabinets are assembled by one person on location. A means to fixedly attach cross-tie plates 114 to housing sections 100 and 102 is provided by bolts 117 which are mounted in aligned holes formed in both the cross-tie plates and flange member 106, and positioned between flat-head pins 110. The opposite outer end of each cross-tie plate 114 is provided with a pair of bayonet slots 116 that are positioned to fit over pins or bolt members 118 which are mounted on an elongated vertical casement member 120 which is integrally formed as part of each closure door 28. That is, each closure door 28 is formed having two sections **29*a* and 29*b* and each panel section is formed as a double-walled panel structure having an outer wall panel member 25 and an inner wall panel 27 which are fixedly attached to each other by means of spot-welding at each recessed shoulder 31 formed within the respective inner walls 27 of the double-walled panel of each panel section 29*a* and 29*b*. The inner wall panel 27 is included as part of the closure doors 28 so as to provide a means to strengthen the overall structure of closure doors 28 and, secondly, to provide a shelf-mounting means 123 for removably mounting shelves 17, as indicated in FIGS. 10 and 11, or any other type of article supporting means that might be used in place of shelves 17. Panel sections 29*a* and 29*b* are connected by inwardly turned rib members 124 which define casement member 120 and are secured together by a suitable means such as bolts or welding. The outer free end of each rib member 124 is offset to provide an elongated channel which is adapted to receive cross-tie plates 114, as mentioned heretofore. In addition to the cross-tie plates, a plurality of strut members 125 are interconnected between rib members 124 and coaxial support housing 98 by suitable attaching means such as bolts 126. File frame assembly 96 is further defined by a rotor top panel 128 that is secured between the oppositely disposed closure doors 28. Top panel 128 is formed having a centrally positioned hole 129 through which stationary positioning pin 92 passes into retainer housing 94 of canopy 30. The lower end of frame assembly 96 includes a pair of bottom closure covers 130, as illustrated in FIGS. 3 through 5 and 10. The bottom closure covers 130 are positioned on both sides of rotary support means and are fixedly mounted to the oppositely arranged closure doors 28 so as to cover base member 32**.

Figure 5:
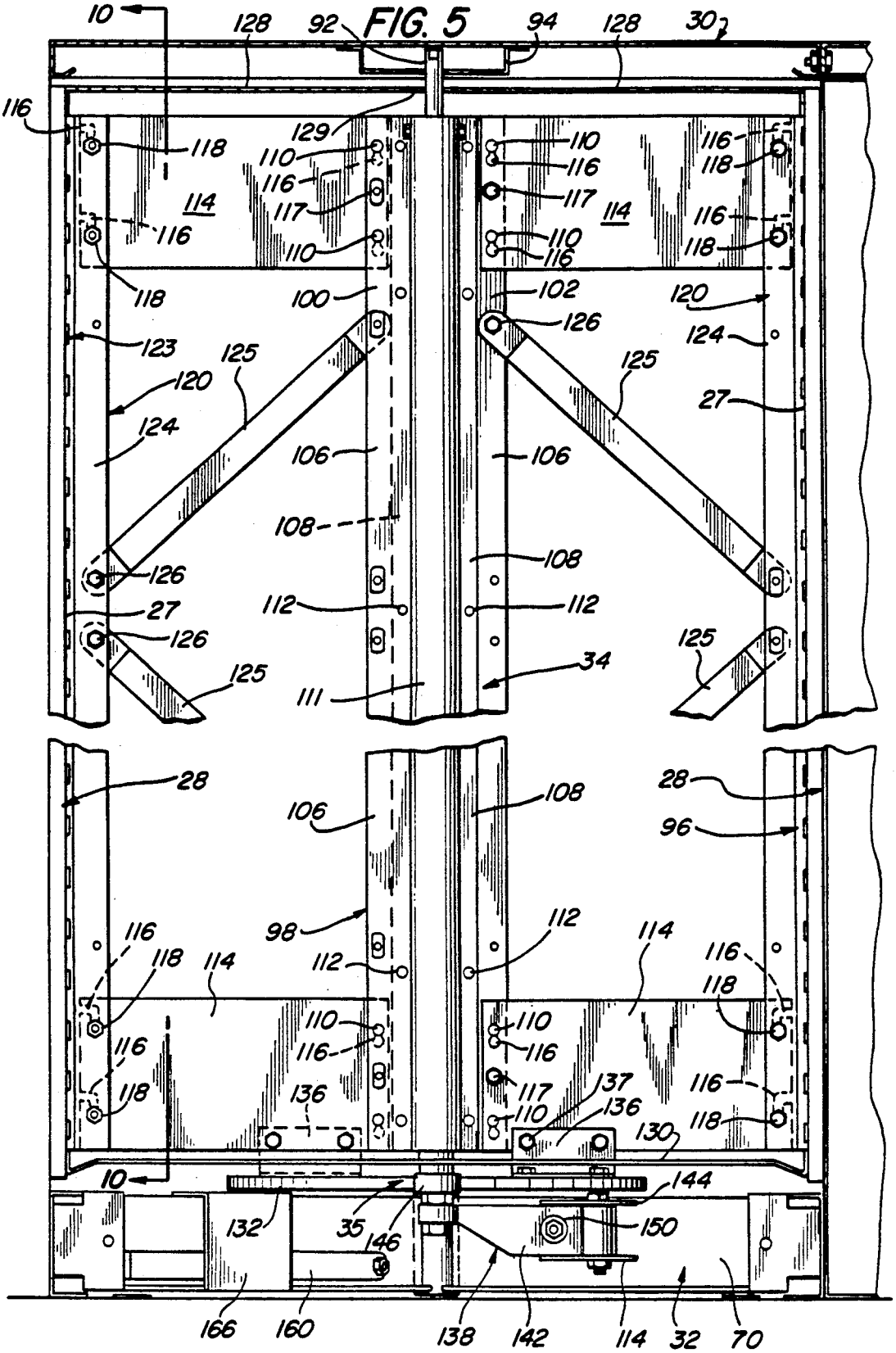
FIG. 5 is an enlarged cross-sectional view taken substantially along line 5—5 of FIG. 3 but without shelves being mounted therein so as to clearly show the framework of the rotor assembly.

Interposed between base 32 and frame assembly 96 is a rotor positioning means 35 and a locking means 36. Rotor positioning means 35 comprises a circular positioning plate 132 having a central hole 134 formed therein to allow the lower end of fixed pole 80 to be positioned therethrough. Positioning plate 132 is fixedly mounted to the lower edge of bottom cross-tie plates 114 by means of depending brackets 136, as illustrated in FIG. 5. Each bracket 136 is secured by means of bolts 137 to both cross-tie plates 114 and circular positioning plate 132. Accordingly, circular plate 132 will rotate about fixed pole 80 as file frame assembly 96 is rotated to either a selected open or closed position. In order to selectively position rotor assembly 14 within the cabinet housing, positioning plate 132 is formed having four equally spaced recesses or semicircular grooves 140 that are located about the peripheral edge of plate 132. A keeper means, generally indicated at 138, is mounted to one of the four extended leg members 70 that define base 32. The keeper means comprises a spring-loaded latch arm member 142 that is pivotally mounted to leg member 70 by means of a mounting bracket 144 which is secured to leg member 70. The free end of arm member 142 includes a roller 146 that engages the peripheral edge of plate 132 by means of biasing spring 148 that causes roller 146 to forcibly engage one of the aligned peripheral recesses as the file frame is rotated in either a clockwise or counterclockwise direction. The biasing force of spring 150 is sufficient to hold the rotatable file frame structure in place and yet allow one to readily rotate the rotor assemble with ease.

Figure 15:
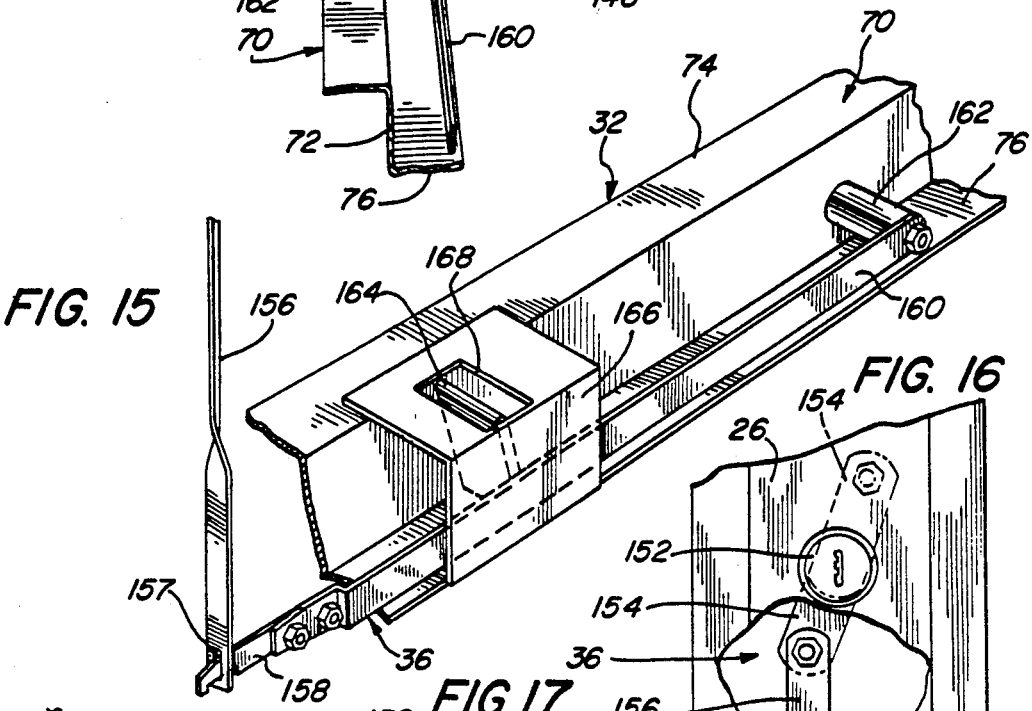
FIG. 15 is a perspective view of the rotor assembly locking apparatus.
Figure 16:
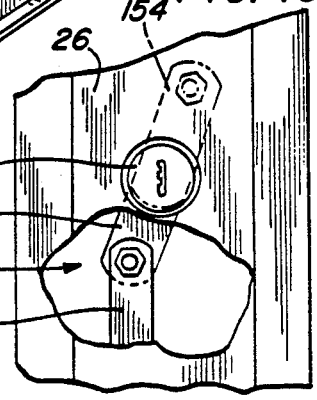
FIG. 16 is a view of the key lock that operates the locking apparatus structure.
Figure 17:
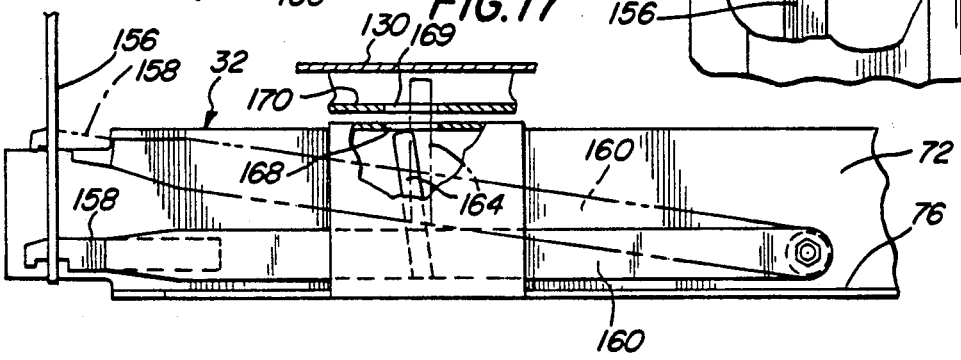
FIG. 17 is a side view of the rotor assembly locking apparatus shown engaging a locking bracket mounted to the underside of rotor assembly framework.

Locking means 36 comprises a suitable key-lock assembly 152 mounted in one of the cabinet post members 26, as illustrated in FIGS. 1A, 1B and 16. Key-lock assembly 152 is provided with an arm member 154 to which is pivotally mounted a vertically disposed lever arm 156 that extends downwardly, as seen in FIGS. 15, 16 and 17, and is adapted with a slot 157 to receive the hooked end 158 of latching arm 160 which is pivotally mounted at 162 to vertical wall member 72 of one of the base leg members 70. A locking tongue 164 is fixedly secured to latching arm 160 and is enclosed in a box-frame member 166 having an opening 168 which allows locking tongue 164 to be raised therethrough so as to be engaged within an aligned open 169 formed in locking bracket 170, as illustrated in FIG. 17, bracket 170 being mounted to the underside of each closure cover 130, as shown in FIGS. 3 and 4. The two openings 168 and 169 are aligned only when the file-frame structure is in a closed position. When a key is positioned in key-lock assembly 152 it can be operated to lock or unlock the rotor assembly 14. In an unlocked mode locking tongue 164 rests below opening 168 of box frame 166, and when in a locked position tongue 164 is raised so as to be received in both openings 168 and 169.

Referring more particularly to the means 123 for mounting various types of shelving, there is illustrated in FIGS. 10 and 11 a plurality of vertically aligned tab members 170 and 172. Tab members 170 are formed adjacent the outer edges of inner walls 27 of both panel sections 29*a* and 29*b*, and are horizontally formed to define vertical slots so as to receive a corresponding vertical finger members 174 that project outwardly from the side wall 175 of shelf member 17. Tab members 172 are formed adjacent the inner edges of inner walls 27 and are stamped outwardly therefrom so as to define a vertical slot to receive a corresponding horizontal finger member 176 that is provided in the front portion of shelf 17. This arrangement between the respective slots and fingers establishes a very simple means of mounting and strongly supporting each shelf at any upper or lower location within the bay sections defined by the file frame structure.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What I claim is:

1. In a rotary file and storage cabinet having a cabinet housing defined by a canopy mounted on two oppositely positioned side walls and two oppositely disposed access openings, said cabinet housing being fixedly mounted to a base member, and a rotor file assembly being rotatably mounted within said cabinet housing, said rotor file assembly having a pair of oppositely disposed closure doors which define a pair of file or storage sections that are positionable to provide access thereto through said access openings of said cabinet housing, the improvement comprising:

a rotor file assembly having a rotary support means mounted on said base member of said cabinet housing, wherein said rotary support means is defined by a vertical axis assembly which is mounted at one end to said canopy and affixed at the opposite end to said base member;

means for vertically positioning said axis assembly at the upper end thereof and centrally within said cabinet housing;

means for fixedly securing said rotary support means to said base member, whereby said axis assembly is prevented from rotating within said cabinet housing;

a file assembly rotatably mounted and supported on said axis assembly;

bearing means mounted on said axis assembly so as to be interposed between said axis assembly and said rotor assembly, whereby said rotor assembly is selectively rotatable about said axis assembly; wherein said axis assembly comprises:

a centrally disposed pole member having a bearing mount formed with a bearing support flange and located in the upper end of said pole member, said bearing means being mounted thereon;

a positioning pin secured to said bearing mount so as to extend upwardly through a retainer means, said retainer means being attached to said canopy; and hold-down means centrally secured in said base member, the lower end of said pole member being fixedly attached therein;

a frame structure defined by said file assembly, whereby said closure doors are mounted thereon;

positioning means mounted to said base member so as to be located between said frame structure and said base member; and locking means mounted within said cabinet housing and arranged to lockingly engage said frame structure when said closure doors are positioned in a closed mode.

2. The rotary file and/or storage cabinet as recited in claim 1, wherein said file assembly includes a rotatable coaxial support housing mounted over said pole member so as to rest on said bearing means, and wherein said frame structure is attached to said coaxial support housing, whereby said frame structure and said closure doors rotate with said coaxial support housing within said cabinet housing.

3. The rotary file and/or storage cabinet as recited in claim 2, wherein said coaxial support housing comprises:

a pair of housing sections, wherein each of said housing sections is defined as an elongated body having a longitudinal semicircular groove and a pair of oppositely disposed flange members, said housing sections being secured together so as to define a shaft to receive said pole member and said bearing means therein for rotation about said pole member, said shaft including a cap member positioned at the upper end thereof; and means for securing said housing sections together.

4. The rotary file and/or storage cabinet as recited in claim 3, wherein said bearing means comprises a plurality of bearing members.

5. The rotary file and/or storage cabinet as recited in claim 3, wherein said bearing means comprises:

a first bearing member mounted on said bearing support flange;

a second bearing member interposed between said pole member and said coaxial support housing and mounted adjacent the upper end thereof; and a third bearing member interposed between said pole member and said coaxial support housing and mounted adjacent the lower end thereof.

6. The rotary file and/or storage cabinet as recited in claim 4, wherein said frame structure comprises:

elongated vertical casement members which are integrally formed as part of each of said closure doors;

a plurality of cross-tie plates interconnected between said coaxial support housing and said casement members, the file or storage sections being defined thereby;

a plurality of strut members interconnected between said coaxial support housing and said casement members; and means for securing said cross-tie plates and said strut members to said casement members.

7. The rotary file and/or storage cabinet as recited in claim 6, wherein at least a first pair of cross-tie plates are mounted adjacent the top of said coaxial support housing, and at least a second pair of cross-tie plates are mounted adjacent the bottom of said coaxial support housing.

8. The rotary file and/or storage cabinet as recited in claim 7, wherein said positioning means comprises:

a circular positioning plate having a central hole formed therein, the lower end of said pole being positioned therethrough, and wherein said positioning plate is fixedly mounted to said second pair of cross-tie plates so as to rotate with said frame structure, said positioning plate being formed along the peripheral edge thereof with four peripheral recesses; and keeper means mounted to said base member and positioned to selectively engage each of said peripheral recesses as said file assembly is rotated about the axis of said pole so as to hold said file assembly in either a closed or open position.

9. The rotary file and/or storage cabinet as recited in claim 8, wherein said keeper means comprises:

an arm member pivotally mounted to said base member;

a roller mounted on the free end of said arm member to engage the peripheral edge of said positioning plate by means of a biasing spring so as to cause said roller to forcibly engage one of said peripheral recesses as said rotor file assembly is rotated in either a clockwise or counterclockwise direction.

10. The rotary file and/or storage cabinet as recited in claim 9, wherein said base member is formed having a plurality of leg members so as to provide a support base for both the cabinet housing and said file assembly, and wherein said keeper means is mounted to one of said leg members.

11. The rotary file and/or storage cabinet as recited in claim 10, wherein said locking means comprises:

a key-lock assembly mounted in said cabinet housing and having a lever arm attached thereto;

an arm member pivotally mounted to said key-lock assembly;

a vertically disposed lever arm pivotally attached to said arm member and having a slot formed in the free end thereof;

a latching arm pivotally mounted at one end thereof to one of said leg members of said base member, the opposite end of said latching arm being mounted in said slot lever arm; and a locking tongue fixedly secured to said latching arm and positioned to be received in a locking bracket mounted to said frame structure, whereby said file assembly is prevented from being rotated to an open position.

12. A rotary file cabinet comprising:

a cabinet housing having a base member on which is mounted two oppositely disposed side walls and two oppositely disposed access openings, said access openings being defined by a pair of post members and a canopy mounted to each of said post members;

a rotor file assembly including a rotor support means centrally mounted in said cabinet housing between said canopy and said base member within said cabinet housing, and a file frame assembly rotatably supported on said rotor support means;

bearing means mounted on said rotor support means, whereby said rotor file assembly is selectively rotatable about said rotor support means;

wherein said rotor support means comprises:

a centrally positioned tubular pole defining a fixed central axis within said cabinet housing and having a bearing mount formed with a bearing support flange located at the upper end of said tubular pole, said bearing means being mounted on said tubular pole;

a positioning pin secured to said bearing mount so as to extend upwardly through a retainer means, said retainer means being attached to said canopy; and hold-down means centrally secured in said base member and said tubular pole, the lower end of said pole being fixedly attached therein;

wherein said file frame assembly includes:

a coaxial support housing, a support frame mounted to said coaxial support housing, and a pair of oppositely disposed closure doors mounted to said support frame, which define a pair of storage bay sections disposed therebetween so as to provide access through said access openings of said cabinet housing;

shelving means, removably mounted in said storage bay sections;

means for vertically positioning said rotor support means within said cabinet housing;

means for fixedly securing said rotary support means between said canopy and said base member, whereby said rotary support means is prevented from rotating therein;

positioning means located between said support frame and said base member, whereby said rotor file assembly can be selectively positioned within said cabinet housing; and locking means mounted in said cabinet housing and arranged to lockingly engage said rotor file assembly when said closure doors are positioned in a closed mode.

13. The rotary file cabinet as recited in claim 12, wherein said coaxial support housing is mounted over said pole with said bearing means being positioned therebetween, whereby said support frame and said attached closure doors rotate with said coaxial support housing within said cabinet housing.

14. The rotary file cabinet as recited in claim 13, wherein said coaxial support housing comprises:

a pair of housing sections, wherein each of said housing sections are defined as having an elongated body including a longitudinal semicircular channel and a pair of oppositely disposed flange members, said housing sections being secured together, and wherein said oppositely positioned channels define a shaft to receive said pole and said bearing means therein for rotation about said pole, said pole including a fixedly secured cap member positioned at the upper end of said shaft of said coaxial support housing;

means for securing said housing sections together; and means for attaching said support frame to said housing section.

15. The rotary file cabinet as recited in claim 14, wherein said bearing means comprises a plurality of bearing members.

16. The rotary file cabinet as recited in claim 3, wherein said bearing means comprises:

a first bearing member mounted on said bearing support flange;

a second bearing bearing member interposed between said pole and said coaxial support housing and mounted adjacent the upper end thereof; and a third bearing member interposed between said pole member and said coaxial support housing and mounted adjacent the lower end thereof.

17. The rotary file cabinet as recited in claim 16, wherein each of said closure doors comprises:

a pair of contiguous interconnected panel sections secured together by means of an elongated vertical casement member formed as part of each of said closure doors;

a plurality of cross-tie plates and strut members interconnected between said coaxial support housing and said casement members so as to define a partition between said oppositely disposed storage bay sections; and means for removably securing said cross-tie plates and said strut members to said casement members.

18. The rotary file cabinet as recited in claim 17, wherein at least a first pair of cross-tie plates are mounted adjacent the top of said coaxial support housing, and at least a second pair of cross-tie plates are mounted adjacent the bottom of said coaxial support housing.

19. The rotary file and/or storage cabinet as recited in claim 18, wherein said positioning means comprises:

a circular positioning plate having a central hole formed therein, whereby the lower end of said pole is positioned therethrough, said positioning plate being fixedly mounted to said second pair of cross-tie plates so as to rotate with said said support frame, said positioning plate being formed along the peripheral edge thereof with four peripheral recesses;

means for attaching said positioning plate to said second pair of cross-tie plates; and keeper means mounted to said base member and positioned to selectively engage each of said peripheral recesses as said file assembly is rotated about the axis of said pole so as to hold said rotor file assembly in either a closed or open position.

20. The rotary file and/or storage cabinet as recited in claim 8, wherein said keeper means comprises:

an arm member pivotally mounted to said base member; and a roller mounted on the free end of said arm member to engage the peripheral edge of said positioning plate by means of a biasing spring so as to cause said roller to forcibly engage said aligned peripheral recesses as said rotor file assembly is rotated in either a clockwise or counterclockwise direction.

21. The rotary file cabinet as recited in claim 20, wherein said base member is formed having a plurality of leg members defining a support base for both said cabinet housing and said rotor file assembly, and wherein said keeper means is mounted to one of said leg members.

22. The rotary file cabinet as recited in claim 18, wherein each of said closure doors is formed having an outer panel and an inner panel, and wherein means are formed in said inner panels for removably mounting shelf members so as to adjustably locate one or more shelf members between the respectively positioned closure doors.

23. The rotary file cabinet as recited in claim 18, wherein each of said post members is formed having a box-like configuration and includes means for fixedly mounting at least one or more flexible strip members to each of said post members to define said access openings in said cabinet housing.

24. The rotary file cabinet as recited in claim 18, wherein said cabinet housing includes a removable rear wall unit to cover one of said two access openings provided therein.

25. The rotary file cabinet as recited in claim 18, including means for contiguously interconnecting two or more cabinet housings, and including a rotor file assembly mounted therein.

26. The rotary file cabinet as recited in claim 25, wherein said means for contiguously interconnecting two or more cabinet housings comprise said post members positioned between said cabinet housings so as to straddle each adjacent base member of each respective cabinet housing.

* * * * *